US007517628B2

(12) United States Patent
Hirano et al.

(10) Patent No.: US 7,517,628 B2
(45) Date of Patent: Apr. 14, 2009

(54) MANUFACTURING METHOD OF ELECTROSTATIC CHARGE IMAGE DEVELOPING TONER, AND ELECTROSTATIC CHARGE IMAGE DEVELOPING TONER

(75) Inventors: Shiro Hirano, Hachioji (JP); Shingo Fujimoto, Fussa (JP); Takao Yamanouchi, Sagamihara (JP); Junya Onishi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 423 days.

(21) Appl. No.: 11/355,358

(22) Filed: Feb. 16, 2006

(65) Prior Publication Data

US 2006/0269861 A1 Nov. 30, 2006

(30) Foreign Application Priority Data

May 26, 2005 (JP) ..... 2005-153671

(51) Int. Cl.
*G03G 9/08* (2006.01)

(52) U.S. Cl. ..... 430/110.2; 430/137.11; 430/137.14

(58) Field of Classification Search ..... 430/110.2, 430/137.14, 137.11
See application file for complete search history.

(56) References Cited

U.S. PATENT DOCUMENTS

2002/0039699 A1* 4/2002 Nishimori et al. ..... 430/137.11
2003/0055115 A1* 3/2003 Ninomiya et al. ..... 516/77
2005/0058927 A1* 3/2005 Mikuriya et al. ..... 430/110.2

* cited by examiner

*Primary Examiner*—John L Goodrow
(74) *Attorney, Agent, or Firm*—Lucas & Mercanti, LLP

(57) ABSTRACT

Disclosed is a toner having a core/shell structure and including a hydrophilic resin and a hydrophobic resin, and a manufacturing method thereof.

15 Claims, 5 Drawing Sheets

FIG. 1 ( A )
RESIN PARTICLE FORMING PROCESS

FIG. 1 ( B )
COAGULATION PROCESS

FIG. 1 ( C )
FUSING-RIPENING PROCESS

MANUFACTURING METHOD OF ELECTROSTATIC CHARGE IMAGE DEVELOPING TONER, AND ELECTROSTATIC CHARGE IMAGE DEVELOPING TONER

TECHNICAL FIELD

The present invention relates to a manufacturing method of an electrostatic charge image developing toner, and an electrostatic charge image developing toner.

BACKGROUND

In view of energy saving, a low temperature fixing technique to minimize electric power consumption has recently been developed in the electrophotographic industry.

There was a problem in storage stability such that an electrostatic charge image developing toner (hereinafter, referred to simply as toner) capable of being fixed at low temperature resulted in toner off-set during image formation, and the toner coagulated during storage in a toner bottle or a cartridge.

In order to achieve a good balance between no occurrence of off-setting and storage stability, methods of preparing a toner including toner particles each having a core/shell structure have recently been intensively studied.

It is known as a process of preparing toner including toner particles each having a core/shell structure that the core is formed by fusing and coagulation of resin particles prepared via polymerization of a polymerizable monomer in a solution, and a shell layer is further formed on the core surface by adding a resin particle solution.

However, in the case of a process of manufacturing toner including toner particles each having a core/shell structure by adding resin particles to prepare the shell after formation of the foregoing core portion, a coagulation/fusing process was required to be conducted twice for forming both the core and the shell. Consequently, as the case stands now, a complicated manufacturing process with a long manufacturing duration is required to be carried out.

(Patent Document 1) Japanese patent O.P.I. Publication No. 2004-109939

(Patent Document 2) Japanese patent O.P.I. Publication No. 2002-116574

SUMMARY

It is an object of the present invention to provide a toner enabling to exhibit good fixability at low temperature, and no occurrence of toner off-setting as well as excellent storage stability, and also to provide a toner manufacturing method of manufacturing toner particles having a core/shell structure, via a simple manufacturing process of a short manufacturing time.

An aspect of the invention is a manufacturing method of an electrostatic charge image developing toner, which comprise a step of forming a particle having a core/shell structure by coagulating resin particles including at least a hydrophilic resin and a hydrophobic resin.

Another aspect of the invention is toner comprising a colorant and a binder resin which includes a hydrophilic resin and a hydrophobic resin, wherein the toner includes a toner particle having a core/shell structure.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DETAILED DESCRIPTION OF THE INVENTION

Figure 1:
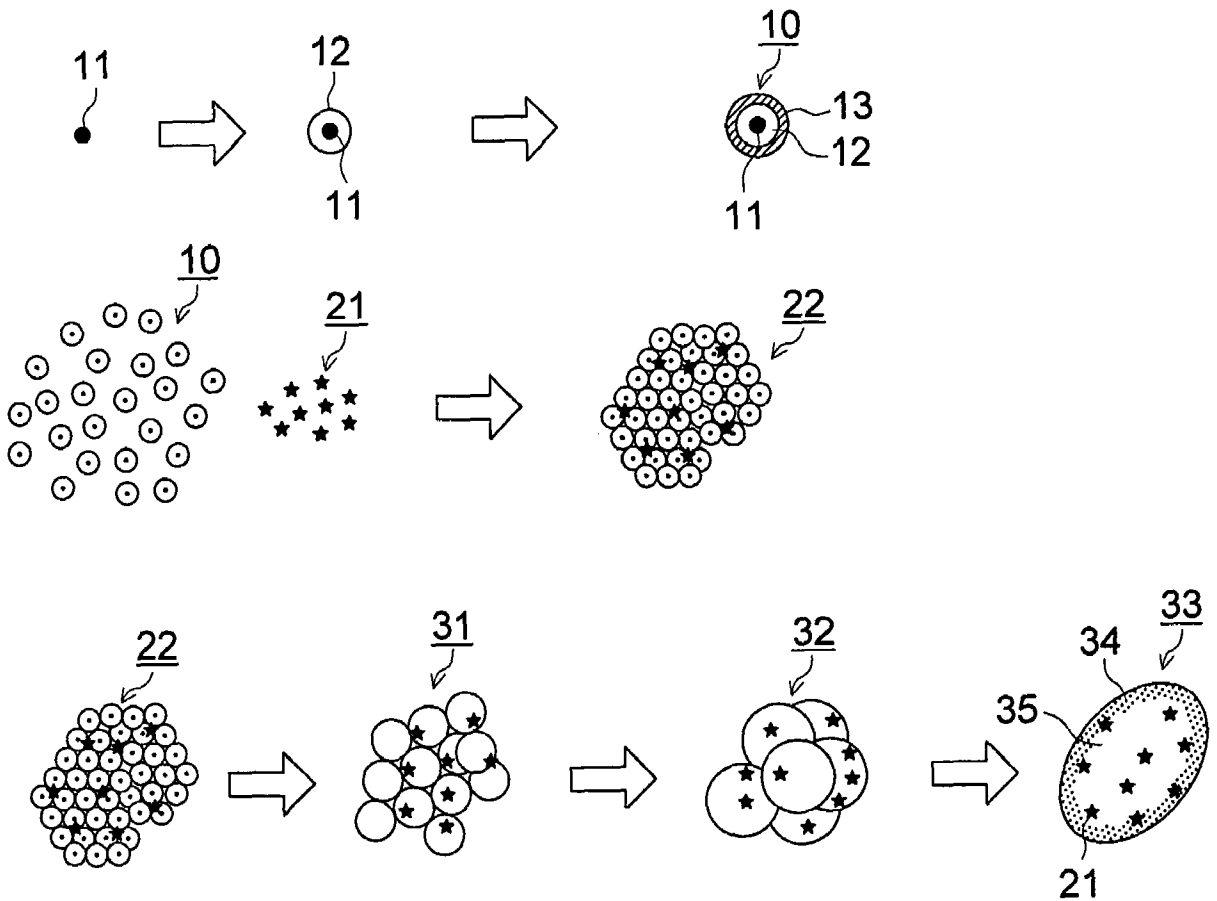
FIG. 1 is an illustration diagram of showing an example of a process in which a core/shell type toner base material is formed.

While the preferred embodiments of the present invention have been described using specific terms, such description is for illustrative purposes only, and it is to be understood that changes and variations may be made without departing from the spirit or scope of the appended claims.

(Structure 1) A manufacturing method of an electrostatic charge image developing toner, wherein a core/shell structure is formed by coagulating resin particles including at least a hydrophilic resin and a hydrophobic resin.

(Structure 2) An electrostatic charge image developing toner, wherein a core/shell structure is formed by coagulating resin particles including at least a hydrophilic resin and a hydrophobic resin.

The present inventors have intensively studied toner including toner particles each having a core/shell structure, capable of exhibiting no occurrence of toner off-setting as well as exhibiting excellent storage stability via a simple manufacturing process of a short manufacturing time.

After considerable effort during intensive studies, the inventors have found out that toner including toner particles each having a core/shell structure composed of a core having a low glass transition temperature (low Tg) and a shell layer having a high glass transition temperature (high Tg) can be produced by a coagulation/fusing process carried out at one time.

Specifically, the hydrophilic resin and the hydrophobic resin are localized onto the outer surface of the toner base material (corresponding to a shell layer) and inside the particle (corresponding to a core), respectively by at least the same time fusing and ripening of coagulation particles with thermal energy, which are prepared by coagulating resin particles composed of a hydrophilic resin having a high glass transition temperature (high Tg) and a hydrophobic resin having a low glass transition temperature (low Tg), to produce a core/shell structure.

The reason why the hydrophilic resin and the hydrophobic resin are localized in coagulation particles is that it is considered that the hydrophilic resin is attracted by an aqueous medium to localize on the outer side, and the hydrophobic resin repels the aqueous medium to localize inside since the hydrophobic resin has a lower Tg than that of the hydrophilic resin.

Toner capable of exhibiting fixability at low temperature, no occurrence of toner off-setting and excellent storage stability is provided via existence of a hydrophilic resin of high Tg on the outer surface of the coagulation particle (being a shell layer) and a hydrophobic resin of low Tg inside (being a core) can be produced.

The case of a commonly known method of preparing toner including toner particles each having a core/shell structure is one in which a complicated manufacturing process requiring a long period of manufacturing time to form a core via coagulation and fusing of resin particles prepared via polymerization of polymerizable monomers in a solution, and a shell layer is further formed on the core by adding a resin particle solution. In this case, a large-scale apparatus is necessary to be arranged since not only resin particles for the core, but also resin particles for the shell layer have to be provided.

In the manufacturing method of the present invention, however, toner having a core/shell structure can be manufactured only by at least simultaneously fusing and ripening of coagulation particles, which are prepared via coagulation of resin particles to realize a simple process of a short manufacturing-duration employing a simplified apparatus.

The toner performance properties such as a heat-resistance storage property and an anti-offset property was also improved since in the core/shell process in the present invention, one process could be reduced in comparison to the existing method of fusing and attaching a particle for the shell onto a core particle. The reason is that a resin composition gradient from the center inside a toner particle to the surface of the particle is generated, whereby a thermal property of the hydrophobic resin remains inside the particle and does not escape to the toner surface, since a core/shell structure is formed via utilizing of a moisture orientation inside the toner particle of the present invention. In the case of a process of coating a core with a particle for the shell, no shell can be suitably coated, and shell layers are peeled and cracked by some external reasons. As the result, a problem is produced in this case such that an intrinsic core particle property is disclosed.

Incidentally, "hydrophilic resin" means a resin in which an acid monomer (polymerizable monomer) is contained in the composition components constituting the resin.

Examples of the acid monomer are those each having a substituent such as carboxyl group, sulfonic acid group and phosphoric acid group as a constituting group of a monomer, and there are specifically given acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamido-2-methylpropanesulfonic acid, acidphosphoxyethyl methacrylate, 3-chloro-2-acidphosphoxypropyl methacrylate.

Provided as composition components constituting the hydrophilic resin (composition components A) are styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl aminoethyl methacrylate, and dimethyl aminoethyl methacrylate; ester acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like, halogenated vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; and acrylic acid or methacrylic acid derivatives such as acrylonitrile, methacrylonitrile, acrylamide, and the like.

The addition content (composition ratio) of an acid monomer in a hydrophilic resin is preferably 0.5-10% by weight, and more preferably 1-5% by weight. A hydrophilic resin is also used preferably in combination with two kinds of acid monomers having a different composition ratio or more. Coating of the entire low heat-resistance hydrophobic resin becomes possible since a hydrophobic resin of a low Tg is coated by two kinds of hydrophilic resins or more.

It is preferable that a hydrophilic resin content ratio occupied in toner is 5-80% by weight.

It is preferred that Tg of hydrophilic resin is higher than Tg of hydrophobic resin.

Specifically, it is preferred that Tg of hydrophilic resin is 3-25° C. higher than Tg of hydrophobic resin.

"Hydrophobic resin" means a resin in which no acid monomer (polymerizable monomer) is contained in composition components constituting the resin. All the resins formed with a polymerizable monomer containing no acid monomer in constituent components of a hydrophilic resin are applicable to the hydrophobic resin. The polymerizable monomer constituting each resin as in combination with hydrophilic resin and hydrophobic resin is not limited.

Resin particles made of at least hydrophilic resin and hydrophobic resin, which are employed in the present invention, may be only one kind of resin particles, or may be an admixture of two or more kinds of resin particles.

In the case of a single kind of resin particle, a resin particle made of hydrophilic resin and hydrophobic resin is employed in a resin particle, and a resin particle having a multi-layer structure made of hydrophobic resin for the core and hydrophilic resin for the shell or a resin particle having a domain structure such that hydrophobic resin is dispersed in hydrophilic resin as domains is used. In the case of two or more kinds of resin particles, a resin particle made of only hydrophilic resin, a resin particle made of only hydrophobic resin and a resin particle made of hydrophilic resin and hydrophobic resin may also be used in combination, provided that hydrophilic resin or hydrophobic resin is definitely contained in any one of these resin particles. A particle having a multi-layer structure is preferred, and a particle having a multi-layer structure in which hydrophilic resin is present on the outermost surface of the particle is particularly preferred since one kind of resin particle is preferably employed due to simple and quick coagulation of resin particle-to-resin particle as resin particles in the present invention.

The toner particle diameter and glass transition temperature in the present invention are explained.

<<Toner Particle Diameter>>

Toner is preferably 3-8 μm in median particle diameter ($D_{50}$) based on volume, and more preferably 4-7 μm.

Measurement of median particle diameter ($D_{50}$) in terms of volume is conducted as described below.

The measurement was carried out by using a COULTER MULTISIZER III (produced by Beckman Coulter Inc.), connected to a computer system (produced by Beckman Coulter Inc.) for data processing. After 20 g of the surfactant solution (surfactant-solution in which a neutral detergent containing a surfactant is diluted with pure water by 10 times) is mixed with 0.02 g of toner for the measurement, the mixture was subjected to an ultrasonic dispersion for one minute to obtain a toner dispersion. This toner dispersion is then poured, using a pipette, in a beaker containing ISOTON II (produced by Beckman Coulter Inc.) placed in a sample stand, until the measured content reaches 5-10% by weight. A counter is set to 25000 counts for the particles to be measured, an aperture diameter is also set to 50 μm, and each frequency value is determined via calculation by dividing the measured range of 1-30 μm into 256 subdivisions. A particle diameter of 50% in cumulative volume fraction from a large cumulative volume fraction designates the median particle diameter based on volume.

Glass transition temperature (Tg) of the present invention can be measured as described below.

The glass transition temperature can be measured employing DSC-7 (Differential Scanning Calorimetry manufactured by Perkin Elmer, Inc.) and TAC7/DX (Thermal Analysis Controller manufactured by Perkin Elmer, Inc.).

The operational procedure includes precisely weighing a toner to 4.5-5.0 mg to two places of decimals; enclosing the toner into an aluminum pan (Kit No. 0219-0041) and setting the pan on DSC-7 sample-holder; and preparing a blank aluminum pan as a reference, wherein the measurement condition has a measurement temperature of 0-200° C., a temperature rising speed of 10° C./min and a temperature dropping speed of 10° C./min. The temperature control of heating-cooling-heating is conducted in that order, and the analysis is based on data during heating at the second position.

"Glass transition temperature" is designated as the temperature at an intersection point of an extension line of a base line before rising of the first endoergic peak and the tangential line shown at the maximum inclination in the range between the rising part of the first endoergic peak and the peak thereof.

[Confirmation of Core/Shell Structure]

A core/shell structure of the toner particles is confirmed by the following method, for example. For the confirmation method employing transmission electron microscopes, LEM-2000 TYPE (manufactured by Topcon Corporation), JEM-2000 FX (manufactured by JEOL Ltd.) and the like are used. Specifically, first, toner particles are sufficiently dispersed in a normal temperature curable epoxy resin, subsequently embedded and molded by pressure after they are dispersed in styrene powder having an approximate particle diameter of 100 nm. After the resulting block is subjected to dyeing employing in combination with ruthenium tetroxide or osmium tetroxide, if desired, and a thin film specimen is prepared employing a microtome equipped with a diamond tooth, micrographs are observed in an approximate magnitude of 10,000 times with a transmission electron microscope (TEM), in which a cross-section of one toner is in a field of view. Next, a boundary between the core and the shell is visually confirmed in the foregoing micrograph while visually observing a region where colorants and wax are present. A scanning probe microscope SPI3800N and a multi-function type unit SPA400 (manufactured by SII Nano Technology Inc.) are employed as a method of detecting hardness difference of resins. After toner is embedded in an epoxy resin and cured at 60° C. spending 24 hours, the cross-section is evened by cutting the surface employing a microtome equipped with a diamond tooth to prepare a block for observation of the toner cross-section. A measuring mode is set to a microviscoelasticity mode (VE-AFM) to measure, employing a scanner FS-100N (in-plane 100 μm and vertically 15 μm) and a microcantilever SN-AF01 made of silicon nitride (0.08 N/m in spring constant). After the oscillation frequency and the oscillation amplitude are set to 3-5 kHz and 4-6 nm, respectively, 4 image planes of a shape image, amplitude A, A sin δ and A cos δ are simultaneously measured in each measuring area of 10 μm×10 μm to confirm the shell layer visually via an amplitude image. The number of toner particles for the measurement is 100 in any of methods, and in the case of a core/shell structure confirmed in the particles not less than 80%, based on the total number of particles, the toner is specified to be a toner having a core/shell structure. A core/shell structure identified via the foregoing core/shell structure confirmation method means that the surfaces of particles not less than 80%, based on the total number of particles are covered by a resin layer. The resin layer means a layer prepared in a state where resin particle-to-resin particle is fused. This state is different from a state of adhesion of particles such as external additive particles and so forth.

<<Toner Manufacturing Method>>

A toner manufacturing method of the present invention will be explained by using FIG. 1, but the present invention is not limited thereto.

FIG. 1 is an illustration diagram of showing an example of a process in which a core/shell type toner base material is formed.

FIG. 1(A) is an illustration diagram of showing a process in which resin particles made of hydrophilic resin and hydrophobic resin via three polymerization steps.

FIG. 1(B) is an illustration diagram of showing a process (coagulation process) in which coagulated particles are formed by coagulating resin particles.

FIG. 1 (C) is an illustration diagram of showing a process (fusing/ripening process) in which a toner base material having a core/shell-structure is formed by simultaneously fusing and ripening coagulated particles.

In FIG. 1, numeral 10 designates resin particle, numeral 11 designates hydrophilic resin portion, numeral 12 designates hydrophobic resin portion, numeral 13 designates hydrophilic resin portion, numeral 21 designates colorant particle, numeral 22 designates coagulation particles, numerals 31 and 32 designate particles in the fusing/ripening process, numeral 33 designates toner base material obtained after completion of the fusing/ripening process, numeral 34 designates shell layer made of hydrophilic resin, and numeral 35 designates core section made of hydrophobic resin.

As shown in FIG. 1, resin particle 10 containing hydrophilic resin and hydrophobic resin is first prepared. Coagulation particles 22 are subsequently formed by coagulating this resin particle 10, and a toner base material having a core/shell structure is prepared by fusing this coagulation particles.

Incidentally, the toner base material is a material at the stage before toner is prepared via treatment of external additives.

Next, the toner manufacturing method will be explained in detail.

A manufacturing method of toner is not specifically limited, provided that coagulation particles are prepared by coagulating resin particles composed of at least a hydrophilic resin and a hydrophobic resin, and the method includes a process of fusing the coagulation particles. Manufacturing methods of resin particles specifically include a suspension polymerization method, an emulsion polymerization method, an emulsion polymerization/coagulation method, a dispersion polymerization method miniemulsion polymerization and coagulation method and a dissolution suspension method.

An emulsion polymerization and coagulation method will be described below.

(Emulsion Polymerization And Coagulation Method)

The emulsion polymerization and coagulation method is a method in which resin particles containing at least a hydrophilic resin and a hydrophobic resin are coagulated and fused in an aqueous medium. Provided as this method, although not specifically limited, may be methods disclosed in, for example, Japanese Patent O.P.I. Publication No. 5-265252, Japanese Patent O.P.I. Publication No. 6-329947, and Japanese Patent O.P.I Publication No. 9-15904. Namely, the toner of the present invention may be formed by the method in which more than one of the dispersion particles of the component materials such as resin particles and a colorant, or particles composed of a resin, a colorant and the like are subjected to salting-out, coagulating and fusing, particularly after the particles are dispersed using these emulsifying agents in water, the resulting dispersion is added with a coagulant of the critical coagulation density or more to be subjected to salting-out, at the same time heat-fusing at a temperature not less than the glass transition point of the formed polymer itself or more to form fused particles while gradually growing the particle diameter, and growth of the diameter is stopped at the time when the intended particle diameter is acquired by adding a large amount of water. A ripening process is further conducted while heating and stirring, and then toner can be formed by drying the particles in a moisture state with fluidity.

In the method of manufacturing the toner of the present invention, the preferred method is a method in which a releasing agent is dissolved in the polymerizable monomer to produce particle dispersion in the aqueous medium mechanically, and composite resin particles formed via the process of polymerizing the polymerizable monomer, and colorant particles are coagulated and fused.

Next, an example of the method of preparing toner via a miniemulsion polymerization and a coagulation method will be explained. Processes of the example may include (1) a process of dissolving or dispersing a releasing agent in a radical polimerizable monomer, (2) a polymerization process to prepare the dispersion of resin particles containing hydrophilic resin and hydrophobic resin, (3) a coagulation process of preparing coagulation particles by coagulating resin particles and colorant particles in an aqueous medium, (4) a fusing/ripening process to prepare a toner base material having a core/shell structure by localizing hydrophilic resin onto the toner base material surface and hydrophobic resin inside the particles after fusing and ripening coagulation particles with thermal energy at the same time, (5) a process of cooling the dispersion of a toner base material, (6) a washing process to remove a surfactant and the like from the toner base material after separating solid components (the toner base material) from the cooled toner base material dispersion, (7) a process of drying the washed toner base material, and (8) an optional process of adding external additives into the dried toner base material.

Next, each of the processes will be explained.

[Dissolving/Dispersing Process]

A releasing agent is dissolved and dispersed in a radical polymerizable monomer via this process to prepare a radical polymerizable monomer solution of the releasing agent.

[Polymerization Process]

As a preferred example of this polymerization process, the radical polymerizable monomer solution containing the foregoing releasing agent obtained via the dissolving/dispersing process is added in an aqueous medium containing a surfactant to form the liquid droplets via application of mechanical energy, and polymerization reaction is subsequently advanced in the liquid droplets by radicals emitted from the radical polymerization initiator. Incidentally, resin particles as the core particle can be added in the foregoing aqueous medium in advance.

This polymerization process can provide resin particles composed of a releasing agent, hydrophilic resin, and hydrophobic resin. These resin particles may be colored particles or un-colored particles. Colored particles can be prepared by being subjected to polymerization treatment of a monomer composition containing colorants. In the case of employing uncolored resin particles, a dispersion of colorant particles is added into a dispersion of resin particles in a fusing/ripening process described later to prepare a toner base material by fusing resin particles and colorant particles.

[Coagulation Process]

A salting-out agent containing an alkali metal salt and an alkali earth metal salt as a coagulation agent of not less than critical coagulation concentration is added in water containing resin particles and colorant particles if desired, to form coagulation particles. Internal additives such as a releasing agent and a charge controlling agent, accompanied with resin particles and colorant particles can also be coagulated in the coagulation process. As for timing of addition of internal additive particles such as resin particles, colorant particles, releasing agent particles and charge controlling agent particles, it is preferred that all the particles have been added by the time when a coagulation particle diameter becomes approximately one half of the final particle diameter.

[Fusing/Ripening Process]

It is preferred that fusing/ripening treatment is conducted via thermal energy (by heating).

Specifically, coagulation particles are fluidized at the level of resin molecules in the particles by heating the particles in the foregoing coagulation process while stirring, a hydrophilic resin which is easily incorporated to water as a medium is moved to the particle surface, and a hydrophobic resin is also moved into the interior of the particle, whereby a hydrophilic resin core and a hydrophobic resin shell are localized respectively to form a toner base material having a core/shell structure. The heating temperature is preferably equal to or higher than the highest glass transition temperature (maxTg) of resins plus 30° C., and more preferably equal to or higher than maxTg plus 40° C., since the resin is desired to be fluidized at the molecular level as a condition of constituting a hydrophobic resin core/hydrophilic resin shell structure. In the case of employing an aqueous medium containing water, the upper limit is preferably less than 100° C. in view of the boiling point of water. Since a certain amount of heating duration is desired to form a core/shell structure via movement of resin molecules within the particles, 0.5-30 hours are approximately desired in inverse proportion to the heating temperature, but it is specifically preferred to be sufficiently fluidized for 2 hours or more. Further, since stirring is to be carried out in a laminar flow in which coalescence of coagulation particle-to-particle is hardly generated, and a uniform temperature distribution is preferred, max-blend blades or full-zone blades are preferably employed in consideration of the shape of stirring blades.

[Cooling Process]

This process is a process of cooling the dispersion of the foregoing toner base material with a cooling rate of 1-20° C./min. Any cooling method can be available, and provided is, for example, a method of introducing a coolant from the outside of the reactor container into the reactor or a method of feeding cooling water directly into the reaction system.

[Washing Process]

This process contains a solid-liquid separation process of separating a toner base material from a dispersion of the toner base material which is cooled down to a preset temperature in the above cooling process, and a washing process of removing the surfactant and the salting-out agent from a solid-liquid separated toner cake (aggregate of a wet toner base material in the cake form). Solid-liquid separation methods are not limited to be used, but provided are a centrifuge separation method, a vacuum-filtration method employing a Buchner funnel or the like, and a filtration method employing a filter press and the like.

[Drying Process]

This process is a process of acquiring a dried toner base material by drying the washed toner cake. Provided as dryers employed in this process are a spray dryer, a vacuum-freeze dryer and a vacuum dryer, but preferably a stationary shelf dryer, a mobile shelf dryer, a fluidized-bed dryer, a tumble-drier, and a stirring type dryer. The water content of the dried toner base material is preferably not more than 5% by weight and more preferably not more than 2% by weight. In the case of the dried toner base material-toner base material coagulating together by weak inter-particle forces, the coagulated toner base material may be pulverized. Examples of the pulverizing treatment apparatus include a jet mill, a HENSCHEL MIXER, a coffee mill, and a food processor.

[External Additive Treatment Process]

This process is a process of adding external additives to the dried toner base material if desired, and of mixing up.

Mechanical mixers such as a HENSCHEL MIXER, a coffee mill and so forth can be used as the mixer of external additive.

Those employed as polymerizable monomers constituting resin particles has been explained.

It is further possible to make resins of a cross linkage structure by using polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

These polymerizable monomers to form the hydrophilic or hydrophobic resin can be polymerized by using radical polymerization initiators. In this case, oil-soluble polymerization initiators can be used for a suspension polymerization method. Provided as this oil-soluble polymerization initiator are azo or diazo polymerization initiators such as 2,2'-azobis-(2,4-dimethylvaleronitrile), 2,2'-azobisisobutyronitrile, 1,1'-azobis(cyclohexane-1-carbonitrile, 2,2'-azobis-4-methoxy-2,4-dimethylvaleronitrile, azobisisobutyronitrile; and peroxide polymerization initiator such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, tris-(t-butylperoxy)triazine, or high polymer initiator having peroxide on the side chain.

Further, when using an emulsion polymerization and a coagulation method, a water-soluble radical polymerization initiator can be used. Provided as the water-soluble polymerization initiator are persulfate such as potassium persulfate and ammonium persulfate, azobisamino dipropane acetate, azobiscyano valeric acid and its salt and hydrogen peroxide.

To adjust the molecular weight of resin, a commonly known chain transfer agent may be utilized. Chain transfer agents utilized are not specifically limited and include mercaptans such as n-octyl mercaptan, n-decyl mercaptan and tert-dodecyl mercaptan; mercaptopropionic acid esters such as n-octyl-3-mercaptopropionic acid ester and the like; terpinolene; carbon tetrabromide; α-methylstyrene dimmer; and so forth.

(Colorant)

Commonly known inorganic or organic colorants may be employed as colorants of the present invention. Specific colorants are shown below.

Black colorants are carbon black such as furnace black, channel black, acetylene black, thermal black, and lamp black, and magnet powder such as magnetite and ferrite.

Examples of colorants for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48; 1, C.I. pigment red 53; 1, C.I. pigment red 57; 1, C.I. pigment red 122, C.I. pigment red 123, C.I. pigment red 139, C.I. pigment red 144, C.I. pigment red 149, C.I. pigment red 166. C.I. pigment red 177, C.I. pigment red 178, and C.I. pigment red 222.

Examples of colorants for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Examples of colorants for green or cyan include C.I. pigment blue 15, C.I. pigment blue 15; 2, C.I. pigment blue 15; 3, C.I. pigment blue 15; 4, C.I. pigment blue 16, C.I. pigment blue 60, pigment blue 62, pigment blue 66, and C.I. pigment green 7.

Incidentally, these colorants can be used singly or two kinds of colorants or more can be selected in combination if desired. The addition amount of colorant is 1-30% by weight, based on the total amount of toner, and is preferably arranged to be set in the range of 2-20% by weight.

(Releasing Agent)

Commonly known compounds can be used for a releasing agent of the present invention.

Examples of these compounds include polyolefin wax such as polyethylene wax or polypropylene wax; long chain hydrocarbon wax such as paraffin wax or sazole wax; dialkyl ketone wax such as distearyl ketone or such; ester wax such as carnauba wax, montan wax, trimethylolpropane tribehenate, pentaerythritol tetrabehenate, pentaerythritol diacetate dibehenate, glycerin tribehenate, 1,18-octadecanediole distearate, trimellitic acid tristearyl, or distearylmaleate; and amide wax such as ethylene diaminebehenyl amide, or trimellitic acid tristearyl amide.

The amount of a releasing agent contained in toner is preferably 1-20% by weight, based on the total amount of toner and more preferably 3-15% by weight.

(Charge Control Agent)

A charge control agent may be added into toner of the present invention, if desired. Commonly known compounds can be used for the charge control agent.

(External Additive)

Commonly known particles can be used as inorganic particles employed for external additives. Specifically, preferable examples of those particles include silica particles, titania particles, alumina particles, and their composite oxides. It is also preferred that these inorganic particles are hydrophobic.

Spherical particles having a number average primary particle diameter of 10-2000 nm can be provided as organic particles used for external additives. Examples of constituent material for organic particles include polystyrene, polymethylmethacrylate, styrene-methylmethacrylate copolymer, and the like.

<<Developer>>

The toner can be employed as a single-component developer or a double-component developer.

When the toner is used as the single-component developer, the toner is usually employed in a form of a non-magnetic single component developer or a magnetic single component developer in which the toner contains a magnetic particle having a diameter of approximately 0.1-0.5 μm, but both developers can be used.

When the toner is employed as the double-component developer by mixing with a carrier composed of magnetic particles, known metals such as iron, ferrite and magnetite and alloys of the metals with another metal such as aluminum and lead are employable. Of these, the ferrite particle is particularly preferred. The particle diameter of the above carrier is preferably 20-100 μm, and more preferably 25-80 μm.

The particle diameter of the carrier can be measured with a laser diffraction type particle size distribution measuring apparatus "HELOS" (manufactured by Sympatec Co., Ltd.), equipped with a wet type dispersing device.

A carrier in which the magnetic particle is coated with a resin and a resin dispersed type carrier in which the magnetic particle is dispersed in a resin can preferably be used. Olefin type resins, styrene type resins, styrene-acryl type resins, silicone resins, ester type resins and fluorine-containing polymer resins are employed as the coating resin, though the resin is not specifically limited. Commonly known resins can be employed for constituting the resin dispersed type carrier without any limitation. For example, styrene-acryl resins, polyester type resins, fluorinated type resins and phenol type resins are usable. Of these, the coat carrier which is coated by styrene-acryl resin is more preferable, since protection of the releasing and durability of external additives can be obtained.

<<Image Formation>>

The toner of the present invention is preferably used in an image forming apparatus based on a contact fixing method in which a transfer material with a toner image formed thereon is passed between heat members constituting a fixing device to fix the image.

The image forming apparatus and the fixing device will be described below.

Figure 2:
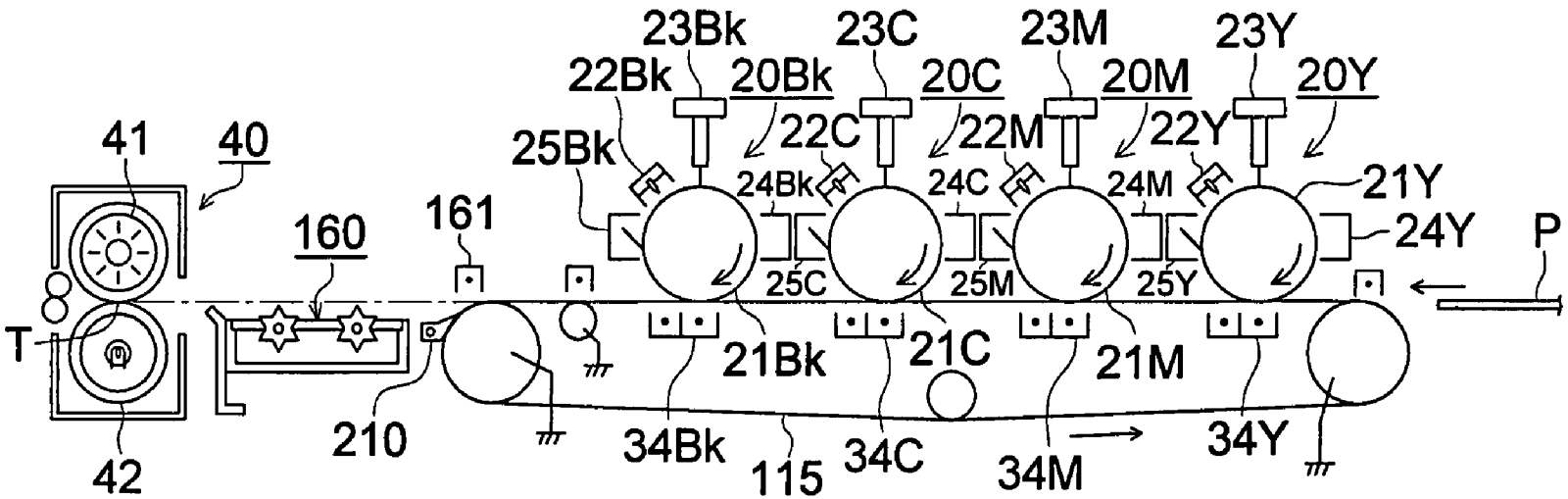
FIG. 2 is a cross-sectional view of showing an example of an image forming apparatus employed in the present invention.

FIG. 2 is a cross-sectional view of showing an example of an image forming apparatus employed in the present invention.

In FIG. 2, symbol 20Y, 20M, 20C or 20Bk designates an image forming unit, symbol 21Y, 21M, 21C or 21Bk designates a photoreceptor drum, symbol 22Y, 22M, 22C or 22Bk designates a scorotron charging device, symbol 23Y, 23M, 23C or 23Bk designates an optical system for exposure, symbol 24Y, 24M, 24C or 24Bk designates a developing device, symbol 25Y, 25M, 25C or 25Bk designates a cleaning device, symbol 34Y, 34M, 34C or 34Bk designates a transfer device, numeral 40 designates a fixing device, numeral 115 designates a transfer material conveyance belt, numeral 160 designates a conveying section, and symbol P designates a transfer material.

The image forming apparatus in FIG. 2 will be described below.

Four image forming units 20Y, 20M, 20C and 20Bk are equipped along with transfer material conveyance belt 115 in the image forming apparatus of FIG. 2.

Each of image forming units is composed of photoreceptor drum 21Y (21M, 21C or 21Bk), scorotron charging device 22Y (22M, 22C or 22Bk), optical system for exposure 23Y (23M, 23C or 23Bk), developing device 24Y (24M, 24C or 24Bk), and cleaning device (cleaning means) 25Y (25M, 25C or 25Bk). Each of toner images formed on photoreceptor drum 21Y (21M, 21C or 21Bk) in each of image forming units is sequentially transferred to transfer material (transfer paper or OHP) P, which is conveyed in accordance with the timing, via transfer device 34Y (34M, 34C or 34Bk) as a transfer means, and is superimposed to form color toner images.

Transfer material P is conveyed by transfer material conveyance belt 115, and is separated from the conveyance belt via discharging with paper separation AC discharging device 161 as a transfer material separation means, and separation nail (separation member) 210 placed in conveying section 160 at predetermined intervals.

Next, transfer material P which is transported to fixing device (fixing means) 40 having heating roller 41 and pressure roller 42 after passing conveyance section 160 is nipped at nip section T formed by heating roller 41 and pressure roller 42, and is ejected to the exterior of the apparatus after toner images superimposed on transfer material P via application of heat and pressure.

A scanning optical system employing a semi-conductor laser as an image exposure light source and a solid scanner such as a LED or a liquid crystal shutter can be used for the foregoing exposure means.

Though used for transfer material conveyance belt 115 to convey the transfer material is an electrically conductive material formed by adding electrically conductive filler such as carbon black and the like into a polymer film such as polyimide, polycarbonate or PVdF, or synthetic rubber such as silicon rubber or fluorine rubber, either a drum type or a belt type is allowed to be used. It is preferred to use a belt type in view of design freedom.

It is also preferable that the surface of a transfer belt is surface-roughened. When ten point surface roughness Rz of the transfer belt is set to 0.5-2 μm, close contact between the transfer material and the transfer belt is improved, and shaking of the transfer material on the transfer belt is avoided, whereby transferability of toner images to the transfer material from a photoreceptor can be improved.

A transfer material employed in the present invention means a support retaining a toner image, which is commonly called an ordinary image support, a transfer member or a transfer sheet. Though specifically provided are various image receiving materials such as plain paper sheets from a thin paper sheet to a thick paper sheet, an art paper sheet, printing paper sheets of a coated paper sheet and such, commercially viable Japanese paper or post card paper sheet, a plastic film sheet for OHP, and cloth, they are not limited thereto.

Figure 3:
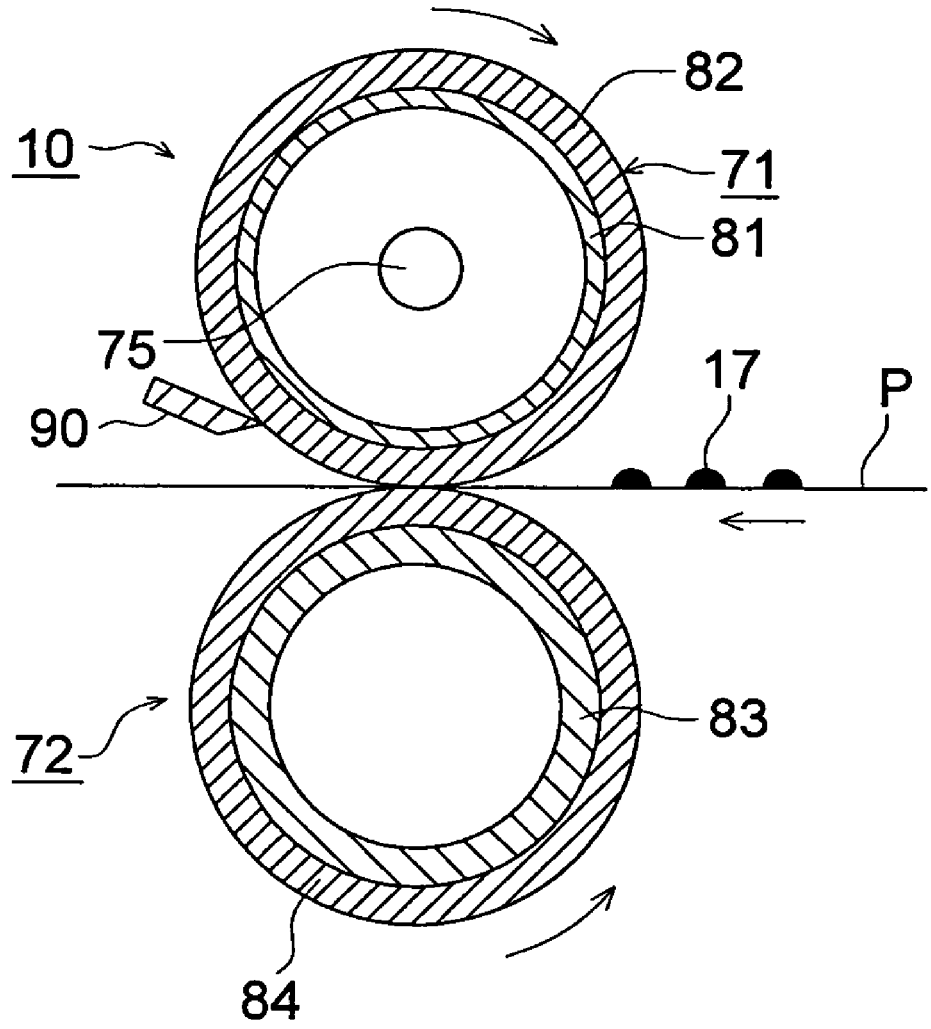
FIG. 3 is a cross-sectional view of showing an example of a fixing device (a type employing a pressure roller and a heating roller) in the present invention.

FIG. 3 is a cross-sectional view of showing an example of a fixing device (a type employing a pressure roller and a heating roller) in the present invention.

Fixing device 10 in FIG. 3 possesses heating roller 71 equipped with separation claw 90 and is equipped with heating roller 71 and pressure roller 72 which is brought into contact with this heating roller. In addition, numeral 17 is a toner image formed on a transfer material (transfer paper sheet) P.

Heating roller 71 possesses a coating layer 82 made of a fluorine resin or an elastic body formed on a surface of cored bar 81, heating roller 71 further possessing heat member 75 composed of a linear heater.

Cored bar 81 is composed of a metal and the inner diameter thereof should be 10-70 mm. The metal constituting cored bar 81 is not specifically limited, but such metals may be provided including, for example, iron, aluminum, copper or alloys of these metals.

The wall thickness of cored bar 81 should be 0.1-15 mm, which is determined considering the balance between the requirement of energy saving (making the wall thinner) and strength (depending on constituent material). For example, in order to keep the strength equivalent to that of the iron cored bar of 0.57 mm in thickness by the aluminum cored bar, the thickness is required to be set to 0.8 mm.

As the fluorine resin constituting the surface of coating layer 82, PTFE (polytetrafluoroethylene) and PFA (tetrafluoroetylene-perfluoro alkylvinylether copolymer) and the like may be provided.

The thickness of coating-layer 82 containing fluorine resin is 10-500 μm, and preferably 20-400 μm.

When the thickness of coating layer 82 containing fluorine resin is less than 10 μm, a function as the coating layer cannot be adequately performed, so that durability as the fixing device cannot be assured. On the other hand, the surface of the coating layer exceeding 500 μm in thickness is likely to have scratches due to paper powders, and toner or such adheres at the scratch portions, resulting in problems such as stained images caused by this.

Further, as the elastic body constituting coating layer 82, silicon rubber and silicon sponge rubber with excellent heat resistance such as LTV, RTV, HTV, and the like are preferably used.

The Asker C hardness of the elastic body constituting coating layer 82 is less than 80°, and preferably less than 60°.

Further, the thickness of coating layer 82 made of an elastic body is preferably 0.1-30 mm, and more preferably 0.1-20 mm.

As heat member 75, a halogen heater may preferably be used.

Pressure roller 72 possessing coating layer 84 made of an elastic body formed on a surface of cored bar 83. As the elastic body constituting coating layer 84 is not specifically limited, but various types of soft rubber and sponge rubber may be provided including polyurethane rubber and silicon rubber, and preferably used are silicon rubber and silicon sponge rubber provided as components of coating layer 84.

Further, the thickness of coating layer 84 is preferably 0.1-30 mm, and more preferably 0.1-20 mm.

Further, the fixing temperature (the surface temperature of heating roller 10) is preferably 70-210° C., and the fixing linear speed is preferably 80-640 mm/sec. The nip width of the heating roller is set to 8-40 mm, and preferably 11-30 mm.

Incidentally, the heating roller may be coated with a silicon oil of 0.3 mg per print or less, which may be also used oil-less.

Figure 4:
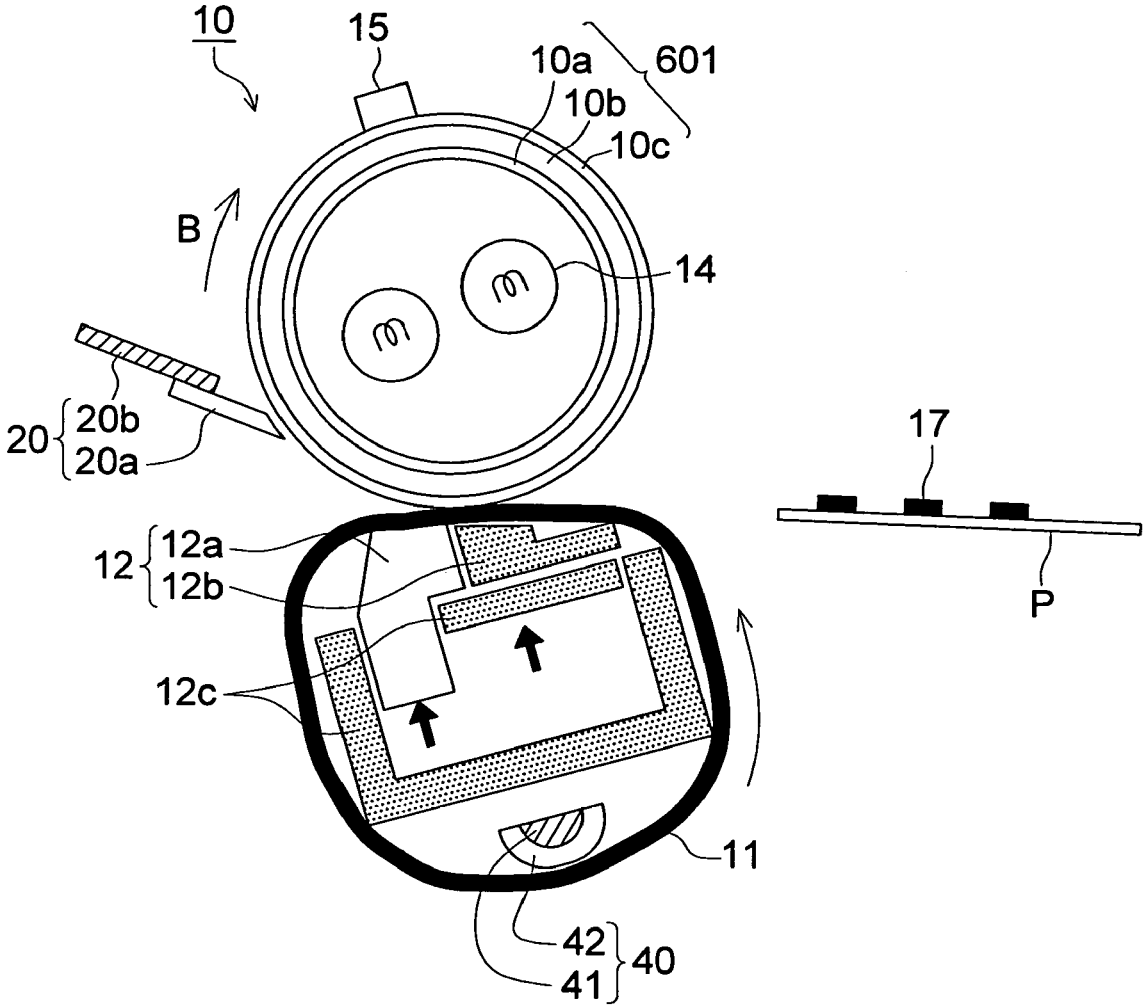
FIG. 4 is an illustration diagram of showing an example of the fixing device (a type using a belt and a heating roller)

FIG. 4 is an illustration diagram of showing an example of the fixing device (a type using a belt and a heating-roller).

The fixing device shown in FIG. 4 is a type using a belt and the heating roller for keeping the nip width, wherein the major section is composed of fixing roller 601, seamless belt 11, pressure pads (pressure members) 12*a* and 12*b* which are pressed against fixing roller 601 via seamless belt 11, and lubricant supplying member 40 (heating roller 41 and pressing roller 42). In addition, peeling member 20 is also held by holder 20*b* so that peeling baffle 20*a* faces against rotating direction B of fixing roller 601.

Fixing roller 601 possesses heat-resistance elastic body layer 10*b* and releasing layer (heat-resistance resin layer) 10*c* which are formed around metal core (cylindrical cored bar) 10*a*, wherein the halogen lamp 14 is provided as a heat source inside core 10*a*. The temperature of the surface of fixing roller 601 is measured with temperature sensor 15, and the halogen lamp 14 is feedback-controlled via measured signals by a temperature controller which is not shown, thereby the surface of fixing roller 601 is controlled so that the temperature thereof remains constant. Seamless belt 11 is contacted as to be wound by a prespecified angle relative to fixing roller 601 to form a nip section.

Inside seamless belt 11 provided is pressure pad 12 having a low friction layer on a surface thereof in the state of being pressed against fixing roller 601 via seamless belt 11. Pressure pad 12 is provided with pressure pad 12*a* to which a strong nip pressure is applied, and pressure pad 12*b* to which a weak nip pressure is applied, and pressure pads 12*a* and 12*b* are held by metal holder 12*c* or such.

Holder 12*c* is further mounted with a belt-travel guide so that seamless belt 11 can slide and rotate smoothly. Because the belt-travel guide rubs against an inner surface of seamless belt 11, a belt-travel guide member is desired to have a low friction coefficient and also has a low heat conduction so as not to take heat away from seamless belt 11.

Figure 5:
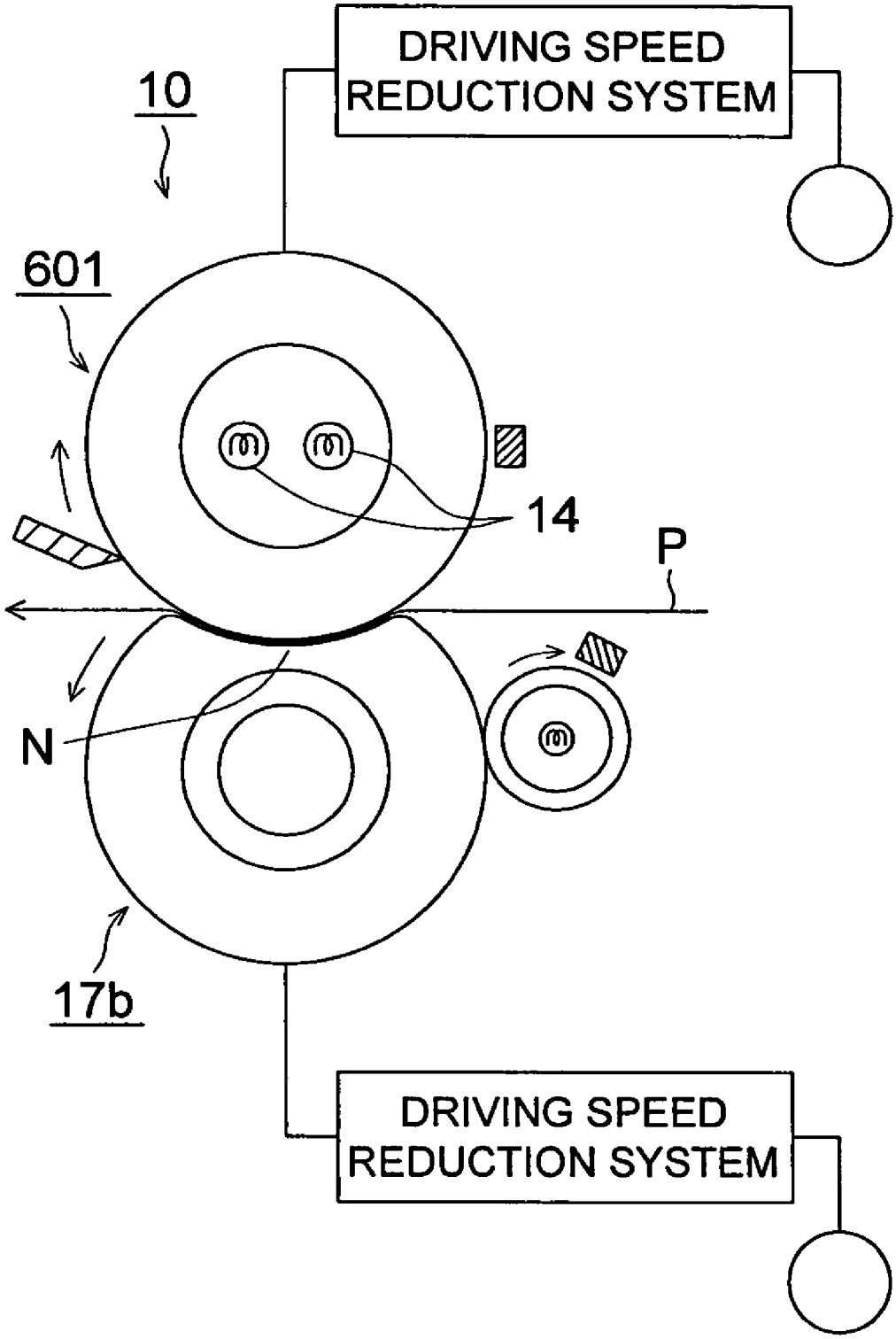
FIG. 5 is an illustration diagram of showing an example of the fixing device (a type using a soft roller and a heating roller) used in the present invention.

FIG. 5 is an illustration diagram of showing an example of the fixing device (a type using a soft roller and a heating roller) used in the present invention.

Fixing device 10 having a fixing nip in FIG. 5, in which winding of a transfer material can be avoided, is a type using the soft roller and the heating roller with excellent image quality, and the fixing device accompanied with halogen lamp as a heat member inside heating roller 601 is equipped with heating roller 601 as a heating roller member and soft roller 17*b* as a soft roller member.

In fixing device 10, nip section N is formed between heating roller 601 and soft roller 17*b*, and when heat and pressure are applied through nip section N, a toner image is fixed on transfer material P. In the above case, the halogen lamp (not shown) as a heat member may also be provided inside soft roller 17*b*.

<<Transfer Material>>

A transfer material employed in the present invention means a support retaining a toner image, which is commonly called an ordinary image support, a recording material or a transfer sheet. Though specifically provided are various image receiving materials such as plain paper sheets from a thin paper sheet to a thick paper sheet, an art paper sheet, printing paper sheets of a coated paper sheet and such, commercially viable Japanese paper or post card paper sheet, a plastic film sheet for OHP, and cloth, they are not limited thereto.

EXAMPLE

Next, the present invention will be explained employing examples, but the present invention is not limited thereto.

<Preparation of Resin Particle>

(Preparation of Resin Particle a) Preparation of Resin Particles Having a Three Layer Structure The First Step Polymerization (Polymerization of Hydrophilic Resin)

8 g of dodecyl sodium sulfate was dissolved in 3000 g of ion-exchange water in a reaction container equipped with a stirring device, a temperature sensor, a cooling tube and a nitrogen introducing device, and the inner temperature was raised up to 80° C. while stirring at a stirring speed of 230 rpm under the nitrogen flow. After raising temperature, the solution in which 10 g of potassium persulfate was dissolved in 200 g of ion-exchange water was also added, the following monomer mixture liquid was dropped to the solution spending 1 hour after the inner temperature was raised up to 80° C. again, and a polymerization process was conducted by heating at 80° C. for 2 hours while stirring to prepare resin particles. This designates "resin particle (1A)".

| | |
|---|---|
| styrene | 564.0 g |
| n-butyl acrylate | 160.0 g |
| methacrylic acid | 76.0 g |
| n-octylmercaptan | 16.0 g |

The 2nd Step Polymerization (Polymerization of Hydrophobic Resin)

7 g of polyoxyethylene (2) dodecylether sodium sulfate was dissolved in 800 g of ion-exchange water in a reaction container equipped with a stirring device, a temperature sensor, a cooling tube and a nitrogen introducing device, and after heating up to 98° C., a mixture-dispersion process was conducted for 1 hour with a mechanical homogenizer "CLEARMIX" (produced by M Tech Co., Ltd.) by adding the solution in which 260 g of the foregoing resin particle (1A) and the following monomer mixture liquid were dissolved at 90° C. to prepare dispersion liquid containing emulsion particles (oil droplets).

| | |
|---|---|
| styrene | 246.0 g |
| n-butyl acrylate | 119.0 g |
| n-octylmercaptan | 1.5 g |
| polyethylene wax (melting point at 80° C.) | 190.0 g |

Next, an initiator solution in which 6 g of potassium persulfate was dissolved in 200 g of ion-exchange water was added into this solution, and the system was polymerized at 82° C. while stirring for 1 hour to prepare resin particles. This designates "resin particle (2A)".

The 3rd Step Polymerization (Polymerization of Hydrophilic Resin)

The solution in which 11 g of potassium persulfate was dissolved in 400 g of ion-exchange water was added into the "resin particle (2A)" solution, and the following mixture liquid was dropped to the solution spending 1 hour.

| | |
|---|---|
| styrene | 432.0 g |
| n-butyl acrylate | 138.0 g |
| methacrylic acid | 30.0 g |
| n-octylmercaptan | 1.0 g |

After dropping of the solution is completed, the inner temperature was cooled down to 28° C., and a polymerization process was subsequently conducted by heating while stirring for 2 hours to prepare resin particles. This designates "resin particle A".

(Preparation of Resin Particles B, C and D) Preparation of Resin Particles Having a Three Layer Structure.

Resin particles B, C and D were prepared by changing the polymerization monomer used for preparing "resin particle A" as shown in Table 1.

(preparation of Resin Particle E) Preparation of Resin Particles Having a Double Layer Structure.

The First Step Polymerization

A mixed liquid containing the following mixture liquid was introduced into a stainless vessel equipped with a stirring device, and was dissolved by heating at 70° C. to prepare a monomer mixture liquid.

| | |
|---|---|
| styrene | 255.5 g |
| n-butyl acrylate | 80.0 g |
| methacrylic acid | 29.0 g |
| n-octylmercaptan | 1.5 g |
| polyethylene wax (melting point at 80° C.) | 190.0 g |

On the other hand, a surfactant solution in which 2 g of polyoxyethylene (2) dodecylether sodium sulfate was dissolved in 1350 g of ion-exchange water was heated to 70° C., and after mixing by adding this solution into the foregoing monomer mixture liquid, the emulsion dispersion liquid was prepared via a mixture-dispersion process conducted at 70° C. for 30 minutes with a mechanical homogenizer having a circulation path "CLEARMIX" (produced by M Tech Co., Ltd.).

Next, an initiator solution in which 7.5 g of potassium persulfate was dissolved in 150 g of ion-exchange water was added into this solution, and the system was polymerized at 78° C. while stirring for 1.5 hours to prepare resin particles.

The $2^{nd}$ Step Polymerization

An initiator solution in which 12 g of potassium persulfate was dissolved in 220 g of ion-exchange water was added into the above-mentioned resulting resin particles, and the following monomer mixture liquid was dropped to the solution spending 1 hour at 80° C.

| | |
|---|---|
| styrene | 402.0 g |
| n-butyl acrylate | 198.0 g |
| n-octylmercaptan | 8 g |

After dropping of the solution is completed, a polymerization process was subsequently conducted by heating while stirring for 2 hours to prepare resin particles, and the inner temperature was subsequently cooled down to 28° C. This designates "resin particle E".

(Preparation of Resin Particle F) Preparation of Resin Particles Having a Double Layer Structure.

Resin particle F was prepared by changing the polymerization monomer used for preparing "resin particle E" as shown in Table 1.

(Preparation of Resin Particle G) Preparation of Resin Particles Having a Single Layer Structure.

A mixed liquid containing the following mixture liquid was introduced into a stainless vessel equipped with a stirring device, and was dissolved by heating up to 70° C. to prepare a monomer mixture liquid.

| | |
|---|---|
| styrene | 259.0 g |
| n-butyl acrylate | 88.0 g |
| methacrylic acid | 18.3 g |
| n-octylmercaptan | 1.5 g |
| polyethylene wax (melting point at 80° C.) | 190.0 g |

On the other hand, a surfactant solution in which 2 g of polyoxyethylene (2) dodecylether sodium sulfate was dissolved in 1350 g of ion-exchange water was heated to 70° C., and after mixing by adding this solution into the foregoing monomer mixture liquid, the emulsion dispersion liquid was prepared via a mixture-dispersion process conducted at 70° C. for 30 minutes with a mechanical homogenizer having a circulation path "CLEARMIX" (produced by M Tech Co., Ltd.).

raised up to 80° C. while stirring at a stirring speed of 230 rpm under the nitrogen flow. After raising temperature, the solution in which 10 g of potassium persulfate was dissolved in 200 g of ion-exchange water was also added, the following monomer mixture liquid was dropped to the solution spending 1 hour after the inner temperature was raised up to 80° C. again, and a polymerization process was conducted by heating at 80° C. for 2 hours while stirring to prepare resin particles. This designates "resin particle I".

| | |
|---|---|
| styrene | 576.0 g |
| n-butyl acrylate | 184.0 g |
| methacrylic acid | 40.0 g |
| n-octylmercaptan | 5.5 g |

Polymerization step number of resin particles A-I, polymerizable monomers thereof, acid monomer composition ratio, and Tg are shown in Table 1.

TABLE 1

| | | 1st step | | | | | 2nd step | | | | | 3rd step | | | | | |
|---|---|---|---|---|---|---|---|---|---|---|---|---|---|---|---|---|---|
| | | Polymerizable monomer | | | Acid monomer | | Polymerizable Monomer | | | Acid monomer | | Polymerizable monomer | | | | Acid monomer | |
| *1 | *2 | St (g) | BA (g) | MAA (g) | composition ratio (%) | Tg (° C.) | St (g) | BA (g) | MAA (g) | composition ratio (%) | Tg (° C.) | St (g) | BA (g) | MAA (g) | AA (g) | composition ratio (%) | Tg (° C.) |
| A | 3 | 564 | 160 | 76 | 9.5 | 61 | 246 | 119 | 0 | 0 | 31 | 432 | 138 | 30 | 0 | 5 | 52 |
| B | 3 | 480 | 200 | 120 | 15 | 55 | 246 | 119 | 0 | 0 | 31 | 462 | 135 | 3 | 0 | 0.5 | 49 |
| C | 3 | 600 | 200 | 0 | 0 | 44 | 237 | 91 | 36.5 | 10 | 50 | 390 | 210 | 0 | 0 | 0 | 26 |
| D | 3 | 500 | 260 | 40 | 5 | 34 | 259 | 88 | 18 | 5 | 50 | 396 | 180 | 24 | 0 | 4 | 38 |
| E | 2 | — | — | — | — | — | 255.5 | 80 | 29 | 8 | 56 | 402 | 198 | 0 | 0 | 0 | 30 |
| F | 2 | — | — | — | — | — | 274 | 91 | 0 | 0 | 44 | 466 | 132 | 0 | 1.8 | 0.3 | 50 |
| G | 1 | — | — | — | — | — | 259 | 88 | 18.3 | 5 | 50 | — | — | — | — | — | — |
| H | 1 | — | — | — | — | — | 245 | 120 | 0 | 0 | 31 | — | — | — | — | — | — |
| I | 1 | 576 | 184 | 40 | 5 | 50 | — | — | — | — | — | — | — | — | — | — | — |

*1: Resin particle No.
*2: Number of layers (Resin configuration)
A: hydrophilic resin + hydrophobic resin + hydrophilic resin,
B: hydrophilic resin + hydrophobic resin + hydrophilic resin,
C: hydrophobic resin + hydrophilic resin + hydrophobic resin,
D: hydrophilic resin + hydrophilic resin + hydrophilic resin,
E: hydrophilic resin + hydrophobic resin,
F: hydrophobic resin + hydrophilic resin,
G: hydrophilic resin, H: hydrophobic resin, and
I: hydrophilic resin
St: styrene,
BA: n-butyl acrylate,
MAA: methacrylic acid,
AA: acryl acid Next, an initiator solution in which 7.5 g of potassium persulfate was dissolved in 150 g of ion-exchange water was added into this solution, and the system was polymerized at 78° C. while stirring for 1.5 hours to prepare "resin particle G".

(Preparation of Resin Particle H) Preparation of Resin Particles Having a Single Layer Structure.

Resin particle H is prepared by replacing the polymerizable monomer employed in preparation of resin particle G into as indicated in Table 1.

(Preparation of Resin Particle I) Preparation of Resin Particles Having a Single Layer Structure.

8 g of dodecyl sodium sulfate was dissolved in 3000 g of ion-exchange water in a reaction container equipped with a stirring device, a temperature sensor, a cooling tube and a nitrogen introducing device, and the inner temperature was 90 g of dodecyl sodium sulfate was dissolved in 1600 g of ion-exchange water while stirring. To this solution, 420 g of carbon black (Regal 330R, product of Cabot Co.) was gradually added with stirring and then dispersed employing a mechanical homogenizer (CLEARMIX, produced by M Technique Co., Ltd.) to obtain a colorant particle dispersion. This designates "colorant dispersion". The colorant particle size of this dispersion, which was measured employing an electrophoresis light scattering photometer (ELS-800, product of Ohtsuka Denshi Co.), was 110 nm.

<<Preparation of Toner>>

<Preparation of Toner Base Material Bk1>

(Coagulation Process)

The solution, in which 300 g of "resin particle A" in terms of solid content conversion, 1400 g of ion-exchange water, 120 g of "colorant dispersion" and 3 g of polyoxyethylene (2) dodecylether sodium sulfate were dissolved, was charged into 120 g of ion-exchange water in a reaction container equipped with a stirring device, a temperature sensor, a cooling tube and a nitrogen introducing device, and after the liquid temperature was set to 30° C., pH was adjusted to 10 by adding 5N of sodium hydrate aqueous solution. Next, an aqueous solution in which 35 g of magnesium chloride was dissolved was added at 30° C. for 10 minutes while stirring. After standing for 3 minutes, temperature was raised up to 90° C. spending 1 hour, and the particle growth reaction continued remaining at 90° C.

At the time when median particle diameter ($D_{50}$) based on volume reached 6.0 μm, the particle growth was terminated by adding an aqueous solution in which 150 g of sodium chloride was dissolved in 600 g of ion-exchange water.

(Fusing/Ripening Process)

After terminating the particle growth, in the fusing/ripening process, hydrophilic resin and hydrophobic resin are localized to the particle surface and inside the particle respectively by heating the liquid at 98° C. while stirring for 2 hours to prepare particles having a core/shell structure by use of stirrer with full-zone blades so as to make a laminar flow.

Thereafter, the liquid was cooled down to 30° C. and the pH is adjusted to 4.0, and then the stirring was stopped.

Particles prepared in the ripening process were separated by a basket type centrifugal separator MARK III type No. 60×40 manufactured by Matsumoto Kikai Mfg. Co. Ltd. to form a wet cake of the toner base material. The wet cake was washed in water employing the above basket type centrifugal separator until separated liquid reached 5 μS/cm in electrical conductivity, and then moved to FLASH JET DRYER and dried until the moisture content was reduced by 0.5% by weight, to prepare toner base material Bk1.

<Preparation of Toner Base Material Bk2>

"Toner base material Bk2" was prepared, similarly to preparation of "toner base material Bk1", except that "resin particle A" used for preparation of "Toner base material Bk1" was replaced to "resin particle B", and temperature and time used in the fusing/ripening process was changed as shown in Table 2.

<Preparation of Toner Base Material Bk3>

"Toner base material Bk3" was prepared, similarly to preparation of "toner base material Bk1", except that "resin particle A" used for preparation of "Toner base material Bk1" was replaced to "resin particle C", and temperature and time used in the fusing/ripening process was changed as shown in Table 2.

<Preparation of Toner Base Material Bk4>

"Toner base material Bk4" was prepared, similarly to preparation of "toner base material Bk1", except that "resin particle A" used for preparation of "Toner base material Bk1" was replaced to "resin particle E".

<Preparation of Toner Base Material Bk5>

"Toner base material Bk5" was prepared, similarly to preparation of "toner base material Bk1", except that "resin particle A" used for preparation of "Toner base material Bk1" was replaced to "resin particle F".

<Preparation of Toner Base Material Bk6>

"Toner base material Bk6" was prepared, similarly to preparation of "toner base material Bk1", except that "resin particle A" used for preparation of "Toner base material Bk1" was replaced to 45 g of "resin particle G" and 255 g of "resin particle H" in terms of solid content conversion.

<Preparation of Toner Base Material Bk7>

"Toner base material Bk7" was prepared, similarly to preparation of "toner base material Bk1", except that "resin particle A" used for preparation of "Toner base material Bk1" was replaced to 270 g of "resin particle E" and 30 g of "resin particle G" in terms of solid content conversion.

<Preparation of Toner Base Material Bk8>

"Toner base material Bk8" was prepared, similarly to preparation of "toner base material Bk1", except that "resin particle A" used for preparation of "Toner base material Bk1" was replaced to "resin particle G".

<Preparation of Toner Base Material Bk9>

"Toner base material Bk9" was prepared, similarly to preparation of "toner base material Bk1", except that "resin particle A" used for preparation of "Toner base material Bk1" was replaced to "resin particle H".

<Preparation of Toner Base Material Bk10>

"Toner base material Bk10" was prepared, similarly to preparation of "toner base material Bk1", except that "resin particle A" used for preparation of "Toner base material Bk1" was replaced to "resin particle D".

<Preparation of Toner Base Material Bk11>

[The 1st Coagulation/Fusing Process (Formation of Core Section)]

The solution, in which 270 g of "resin particle D" in terms of solid content conversion, 1400 g of ion-exchange water, 120 g of "colorant dispersion" and 3 g of polyoxyethylene (2) dodecylether sodium sulfate were dissolved, was charged into 120 g of ion-exchange water in a reaction container equipped with a stirring device, a temperature sensor, a cooling tube and a nitrogen introducing device, and after the liquid temperature was set to 30° C., pH was adjusted to 10 by adding 5N of sodium hydrate aqueous solution. Next, an aqueous solution in which 35 g of magnesium chloride was dissolved was added at 30° C. for 10 minutes while stirring. After standing for 3 minutes, temperature was raised up to 90° C. spending 1 hour, and the particle growth reaction continued remaining at 90° C.

The coagulation particle diameter was measured in this state by COULTER MULTISIZER III (produced by Beckman Coulter), and at the time when median particle diameter ($D_{50}$) based on volume reached 5.0 μm, 260 g of "resin particle I" was added to keep growing particles. At the time when median particle diameter ($D_{50}$) based on volume reached 6.0 μm, the particle growth was terminated by adding an aqueous solution in which 40.2 g of sodium chloride was dissolved in 1000 g of ion-exchange water. Further, fusing treatment was conducted at a liquid temperature of 98° C. while stirring for 6 hours, and a core section in which median particle diameter ($D_{50}$) based on volume was 5.0 μm was prepared. In stirring, a stirrer with full-zone blades was employed.

[The 2nd Coagulation/Fusing Process (Formation of Shell Layer)]

30 g of "resin particle I" was added into the solution in which the above core section was formed, and "resin particle I" was coagulated and fused on the particle surface of the core section while keeping stirring for 3 hours. An aqueous solution in which 40.2 g of sodium chloride was dissolved in 1000 g of ion-exchange water was added into the solution, and after cooling down at 8° C./min, pH was adjusted to 4.0 by adding hydrochloric acid. At this time, stirring was stopped.

[Washing/Drying Process]

Particles prepared in the above process were separated by a basket type centrifugal separator MARK III type No. 60×40 manufactured by Matsumoto Kikai Mfg. Co. Ltd. to form a wet cake of the toner base material. The wet cake was washed in water employing the above basket type centrifugal separator until separated liquid reached 5 μS/cm in electrical conductivity, and then moved to FLASH JET DRYER and dried until the moisture content was reduced by 0.5% by weight, to prepare "toner base material Bk11".

(External Additive Mixture to Toner Base Material)

The above "toner base materials Bk1-Bk11" were prepared by adding 1% by weight of hydrophobic silicon oxide (number average primary particle diameter of 12 nm and hydrophobicity of 68) and 1% by weight of hydrophobic titanium oxide (number average primary particle diameter of 20 nm and hydrophobicity of 63) to mix with a "HENSCHEL MIXER" (manufactured by Mitsui-Miike Chemical Industry Co., Ltd.) to prepare "toner base materials Bk1-Bk11".

Resin particles used in the coagulation process, the fusing (ripening) temperature, resin particles used in the shell layer forming process, the fusing (ripening) process, and time required to form the shell layer are shown in Table 2.

TABLE 2

| | Manufacturing process | | | | | Median particle diameter |
|---|---|---|---|---|---|---|
| | Coagulation process | Fusing/ripening process | | Shell layer forming process | | ($D_{50}$) based on |
| Toner No. | Resin particle | Temp. (° C.) | Time (hr) | Resin particle | Time (hr) | volume (μm) |
| Bk1 | A | 98 | 2 | — | — | 5.9 |
| Bk2 | B | 80 | 3 | — | — | 6.0 |
| Bk3 | C | 98 | 0.35 | — | — | 6.0 |
| Bk4 | E | 98 | 1 | — | — | 5.9 |
| Bk5 | F | 98 | 1 | — | — | 5.9 |
| Bk6 | G + H | 98 | 2 | — | — | 6.1 |
| Bk7 | E + G | 98 | 2 | — | — | 6.1 |
| Bk8 | G | 98 | 2 | — | — | 6.0 |
| Bk9 | H | 98 | 2 | — | — | 6.0 |
| Bk10 | D | 98 | 2 | — | — | 6.0 |
| Bk11 | D | 98 | 2 | I | 3 | 6.0 |

(Preparation of Toners C1-C11)

"Toners C1-C11" were prepared, similarly to preparation of "toners Bk1-Bk11", except that 20 g of Regal 330R (produced by Cabot Co.) was replaced to 10 g of "C.I. pigment blue 15:3".

(Preparation of Toners M1-M11)

"Toners M1-M11" were prepared, similarly to preparation of "toners Bk1-Bk11", except that 20 g of Regal 330R (produced by Cabot Co.) was replaced to 17 g of "C.I. pigment red 122".

(Preparation of Toners Y1-Y11)

"Toners Y1-Y11" were prepared, similarly to preparation of "toners Bk1-Bk11", except that 20 g of Regal 330R (produced by Cabot Co.) was replaced to 18 g of "C.I. pigment yellow 74".

Incidentally, manufacturing processes of "toners C1-C11", "toners M1-M11" and "toners Y1-Y11", and time required to prepare them are omitted due to the same manufacturing process and time as in "toners Bk1-Bk11".

<<Preparation of Developer>>

Each of developers having 6% by weight in toner density was prepared by mixing a ferrite carrier having a volume median particle diameter of 50 μm, in which silicon resin was coated on each of the toners produced as described above.

<<Evaluation>>

The following items of the toners described above were evaluated. In addition, the developer was used corresponding to each toner. Incidentally, as to evaluated results, a and b indicate "pass" with no problem, and c and d indicate "fail" with a problem.

(Visual Evaluation)

<Storage Stability>

2 g of each toner prepared as above was placed in a sample tube. After shaking the tube 500 times employing a tapping denser, the tube was allowed to stand for two hours under an ambience of 55° C. and 35% RH. Subsequently, the resulting toner was placed in a 48 mesh sieve and was sieved under definite vibration conditions. The ratio (in % by weight) of the residual toner amount remaining on the sieve was determined. The resulting ratio was designated as a toner coagulation ratio, and the storage stability of toner was evaluated to rank as described below.

a: The toner coagulation ratio is less than 15% by weight. (Excellent storage stability)

b: The toner coagulation ratio is 15-45% by weight. (Good storage stability)

d: The toner coagulation ratio exceeds 45% by weight. (Refrigerated Transport Required)

(Image Evaluation)

An image forming apparatus described in FIG. 2, equipped with a fixing device in FIG. 4, was used for image evaluation. In addition, the fixing speed and the heat roll surface material were used as shown below.

Fixing speed: 280 mm/sec (about 50 sheets/A4-size, transverse feed)

Heat roll surface material: PTFE

Heat roll surface temperature: 140° C.

Using the foregoing evaluation device, each toner described above was sequentially filled to carry out printing, and the following items were evaluated.

<Fixing Off-Set>

The fixing off-set evaluation was conducted under the low-temperature and humidity environment (10° C. and 20% RH) employing a line image original with a pixel ratio of 5%. The continuous printing was carried out on 1000 sheets of A4-size fine-quality paper (65 g/m$^2$) with humidity controlled in the same environment, and a visual observation was made directly on the images and the heat roll surface after completion of the 1000-sheet printing and an evaluation was made via an off-setting degree of toner adhesion generated on the printed images and the heat roll surface.

Evaluation Criterion a: No off-set occurrence is observed neither on the images nor the heat roll surface. (Excellent)

b: No off-set occurrence is observed on the images, but on the heat roll. (No problem in practical application)

d: Stains caused by off-setting occur on the images.

(A problem in practical application)

<Fixable Temperature>

As to the fixable temperature evaluation, the temperature of the transfer material immediately after discharged from the heat roll was varied from 90° C. through 200° C. at every 10° C. at normal temperature and humidity environment (20° C.

and 50% RH) to prepare fixed images. Incidentally, A4-size fine-quality paper (65 g/m$^2$) was used as the transfer material.

The fixable temperature was provided from the fixing strength of the resulting fixed images which was measured employing a method in accordance with a mending tape peeling method described in "DENSHISYASHIN GIJYUTSU NO KISO TO OUYOU (Fundamental Electrophotographic Technology and Its Application): edited by Imaging Society of Japan" Chapter 9, Section 1.4. More specifically, the transfer material surface temperature was varied, and for each of the temperatures, a 5 mm square solid fixed image with toner adhesion of 0.6 mg/cm$^2$ was prepared, and image densities before and after peeling by "Scotch mending tape" (manufactured by Sumitomo 3M Co., Ltd.) were measured, and then the residual ratio of image density was acquired as a fixing ratio.

Tape Peeling Method (1) Measuring absolute reflection density $D_0$ of a 5 mm square black solid.

(2) Lightly applying "mending tape" (corresponding to No. 810-3-12, manufactured by Sumitomo 3M Co., Ltd.).

(3) Rubbing the tape 3.5 times in both ways with a pressure of 1 kPa.

(4) Peeling the tape at an angle of 180° and with a strength of 200 g.

(5) Measuring absolute reflection density $D_1$ after peeling.

(6) Fixing ratio=$100 \times D_1/D_0$ (%)

The fixing temperature at which a fixing ratio of not less than 90% was evaluated as a fixable temperature. In addition, reflection density meter "RD-918" (manufactured by Macbeth Co., Ltd.) was used for the measurement.

Evaluation results are shown in Table 3.

TABLE 3

| | Toner No. | Number of Manufacturing processes | Toner storage stability | Fixing offset | Fixable temperature (° C.) |
|---|---|---|---|---|---|
| Example1 | Bk1 | One process Less | a | a | 110 |
| Example2 | Bk2 | One process Less | a | a | 110 |
| Example3 | Bk3 | One process Less | b | a | 110 |
| Example4 | Bk4 | One process Less | b | a | 110 |
| Example5 | Bk5 | One process Less | b | a | 110 |
| Example6 | Bk6 | One process Less | a | b | 115 |
| Example7 | Bk7 | One process Less | a | b | 115 |
| Comparative example 1 | Bk8 | One process Less | a | d | 150 |
| Comparative example 2 | Bk9 | One process Less | d | d | 90 |
| Comparative example 3 | Bk10 | One process Less | d | d | 115 |
| Comparative example 4 | Bk11 | One process More | a | d | 115 |

As is apparent from the evaluation results, it is to be understood that Examples 1-7 were excellent in every evaluation item due to the simple manufacturing process, but Comparative examples 1-4 produced problems in several evaluation items, and Comparative example 4 had problems caused by a complicated process with longer time required for toner preparation.

As is clear from the examples, the present invention can provide fixability at low temperature, and also provide a toner manufacturing method as well as a toner capable of manufacturing the toner having a core/shell structure, exhibiting no occurrence of toner off-setting as well as excellent storage stability via a simple manufacturing process of a short manufacturing time.

What is claimed is:

1. A manufacturing method of an electrostatic charge image developing toner, comprising the steps of:

coagulating resin particles comprising at least a hydrophilic resin and a hydrophobic resin to form coagulated particles; and ripening the coagulated resin particles in an aqueous medium with thermal energy so as to localize coagulated resin particles made of the hydrophilic resin in a toner base material on a surface side of the toner base material via attraction of the aqueous medium, wherein the toner base material is a toner material at a stage before the toner is prepared via an external additive treatment.

2. The method of claim 1, wherein a glass transition point of the hydrophilic resin is higher than that of the hydrophobic resin.

3. The method of claim 2, wherein the glass transition point of the hydrophilic resin is 3-25° C. higher than that of the hydrophobic resin.

4. The method of claim 1, wherein the temperature of the aqueous medium having the coagulated resin particles is maintained equal to or higher than the highest Tg of the resin plus 30° C. for half an hour or more.

5. The method of claim 4, further comprising stirring the coagulated resin particles in the aqueous medium by employing max-blend blades or full-zone blades at least during the ripening step.

6. The method of claim 5, wherein the stirring is carried out in a laminar flow.

7. The method of claim 1, wherein the hydrophilic resin is derived from at least an acid monomer having at least one of a carboxyl group a sulfonic acid group and a phosphoric acid group.

8. The method of claim 7, wherein the acid monomer component in the hydrophilic resin is in an amount of 0.5-10% by weight.

9. The method of claim 1 wherein each of the resin particles comprises the hydrophilic resin and the hydrophobic resin.

10. A toner comprising a colorant and a binder resin which includes a hydrophilic resin and a hydrophobic resin, wherein the toner includes a toner particle obtained by a method comprising the steps of:

coagulating resin particles comprising at least the hydrophilic resin and the hydrophobic resin to form coagulated resin articles; and ripening the coagulated resin particles in an aqueous medium with thermal energy so as to localize coagulated resin particles made of the hydrophilic resin in a toner base material on a surface side of the toner base material via attraction of the aqueous medium, wherein the toner base material is a toner material at a stage before the toner is prepared via an external additive treatment.

11. The toner of claim 10, having a median particle diameter ($D_{50}$) based on volume of 3-8 μm.

12. The toner of claim 10, wherein a content ratio of the hydrophilic resin occupied in toner is 5-80% by weight.

13. The toner of claim 10, wherein a glass transition point of the hydrophilic resin is higher than that of the hydrophobic resin.

14. The toner of claim 13, wherein the glass transition point of the hydrophilic resin is 3-25° C. higher than that of the hydrophobic resin.

15. The toner of claim 10, wherein the hydrophilic resin comprises at least one of a carboxyl group, a sulfonic acid group and a phosphoric acid group.

* * * * *